United States Patent [19]

Baker

[11] Patent Number: 4,580,787

[45] Date of Patent: Apr. 8, 1986

[54] GAME BOARD WITH COLORED HEXAGONAL SPACES AND COLORED CONNECTING SPACES

[76] Inventor: Robert D. Baker, 15 Muth Dr., Orinda, Calif. 94563

[21] Appl. No.: 145,353

[22] Filed: May 1, 1980

[51] Int. Cl.[4] ..... A63F 3/02

[52] U.S. Cl. ..... 273/261

[58] Field of Search ..... 273/236, 253, 255, 260, 273/261, 262, 282, 287

[56] References Cited

U.S. PATENT DOCUMENTS

| | | | |
|---|---|---|---|
| 1,704,819 | 3/1929 | Beaman | 273/261 |
| 3,724,856 | 4/1973 | Welch | 273/261 |
| 3,778,065 | 12/1973 | Hale | 273/261 |
| 3,920,247 | 11/1975 | Jenkins | 273/261 |

FOREIGN PATENT DOCUMENTS

| | | | |
|---|---|---|---|
| 1001122 | 8/1965 | United Kingdom | 273/262 |

*Primary Examiner*—Richard C. Pinkham
*Assistant Examiner*—Matthew L. Schneider
*Attorney, Agent, or Firm*—Harry A. Pacini

[57] ABSTRACT

A modified chess game and game board having a hexagonal shape and 217 hexagonal spaces which can be played by two or three players simultaneously. The hexagonal spaces which make up the game board are alternately colored so that no two adjacent spaces are of the same color. Connecting spaces are located between each of the adjacent hexagonal spaces and these connecting spaces are of a color that is different from the color of the two adjacent spaces which they connect. The game also includes 19 playing pieces for each player. The game board can also be used to play a game of checkers.

5 Claims, 10 Drawing Figures

GAME BOARD WITH COLORED HEXAGONAL SPACES AND COLORED CONNECTING SPACES

BACKGROUND OF THE INVENTION

1. Field of Invention

This invention relates to a new and novel game and game board providing a playing surface on which checkers, chess and games in the general style thereof are arranged to be played.

2. Description of the Prior Art

No patents exist which disclose a general styled chess game played by two or three players using a hexagonal game board with hexagonal spaces.

Hexagonal game boards are disclosed in U.S. Design Pat. Nos. 34,678, 57,430, 233,055 and U.S. Pat. Nos. 830,288 and 1,704,819. The game boards in 830,288 contains fifty-five half-red and half-black circles, four half-red and half-black hexagonal spaces and two half-red and half-black octagonal places. The movement of the playing pieces and design of the game board is substantially different from that of the present invention to be distinguished hereinafter. U.S. Pat. No. 1,704,819 relates to a hexagonal game board with neutral zones disposed about a playing field. Further, the movement of the men involves the neutral zone and affects the path of the movement of the pieces of play.

SUMMARY OF THE INVENTION

The invention relates to a modified chess game which can be played by two or three players simultaneously. The game apparatus includes a hexagonal chess board having spaces of three different colors, two or three different colored sets of chess pieces.

An object of the invention is to provide a game board for a new and novel game substantially in the general style similar to chess for two or three players.

Another object of the invention is to provide a game board so arranged substantially hexagonal in shape with hexagonal spaces for play of the game pieces.

Another object of the invention is a game device by which an interesting and challenging game may be played the general style of which is similar to that of checkers and chess.

Still another object of this invention is to provide a chess game which may be played by two or three players with conventional chess pieces that move substantially as in conventional chess.

Other objects, features and advantages of the present invention will be readily apparent from the following detailed description in connection with the accompanying drawings.

DESCRIPTION OF THE INVENTION

Figure 1:
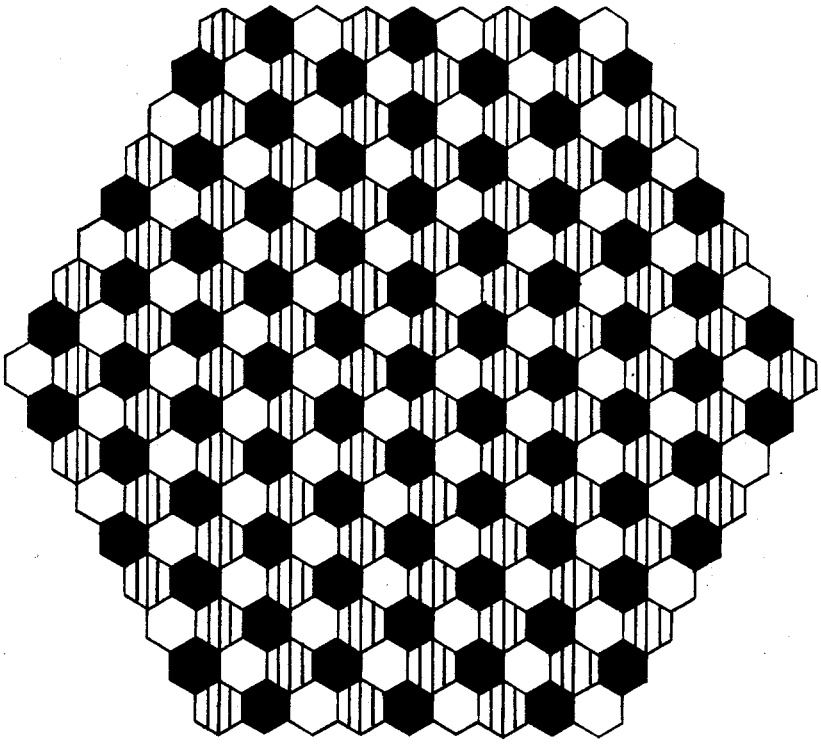
FIG. 1 is a top plan view of the whole game board in accordance with the invention.
Figure 2:
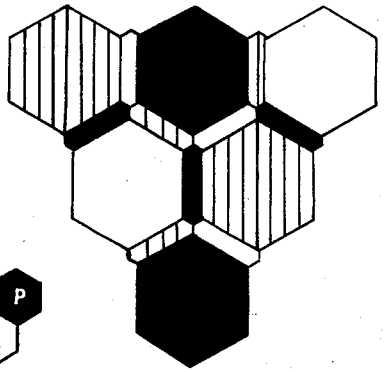
FIG. 2 is an expanded view of a segment showing connecting pieces between the hexagonal spaces.

Referring to the drawings wherein reference to the various views refer to like and corresponding parts throughout the several figures, the preferred embodiment of the invention is disclosed in FIGS. 1–10 and includes a hexagonal board with hexagonal spaces up to three sets of chess pieces. The board generally has a playing surface containing 217 spaces, of which 72 are white or other light color, 72 are red or medium color, and 73 are black or other dark color. The board has rows of alternating colored hexagonal spaces with no two hexagonal spaces of the same color adjacent to each other. FIG. 1 represents a complete board. FIG. 2 represents an expanded view of a segment showing connecting pieces between the hexagonal spaces. These connecting pieces are colored members of the third color not represented in the two adjacent spaces. Present on the board is a plurality of different contrasting colored armies up to three, normally the armies are colored white, red and black. Each army is used by a player in a strategic battle.

Figure 3:
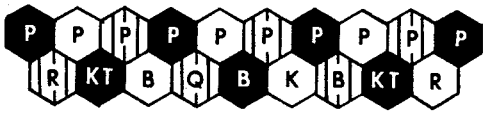
FIG. 3 is a view showing only a segment of the game board with an initial set-up as for a chess game.

Each army or sets of chess pieces contains 19 conventional chess pieces; 10 Pawns, 2 Rooks, 2 Knights, 3 Bishops, 1 Queen and 1 King. Three Bishops are required since in each initial set-up, FIG. 3, there are three different colored spaces. Each set of 19 pieces is initially positioned in the spaces in the first two rows along alternating sides of the hexagonal playing board up to three sides being used. FIG. 3, the third Bishop is placed on the board in the space between the King and Queen. The king is on the space to the right of the third Bishop and the Queen is on the space to the left of the third Bishop. Ten Pawns are required to fill the second row as in FIG. 3.

Therefore, the 19 pieces of each set are positioned in the 19 interior hexagonal spaces bordering alternate sides of the game board. The pieces move in the same manner as in regular chess, that is, the movement of the pieces are squarely or diagonally. Squarely is meant to describe the movement of a playing piece from edge to edge, i.e., side to side of the game board. Diagonally is meant to describe movement of a playing piece from corner to corner on the same color. No one piece may be moved more than once in each turn. The play from player to player moves in a clockwise direction form red to white to black. If a player is placed in check, it becomes that player's turn immediately. For example, if the black player places the white player in check, which is contrary to the normal direction of play, then the direction reverses to the white player and continues in a counter-clockwise direction. Play continues in the counter-clockwise direction until another check will turn the direction of play in the opposite direction.

Within one embodiment of the game board is provision for a movable indicator arrow which aids in informing the players of the direction of play. The movable indicator arrow is turned appropriately to indicate the direction of play.

Figure 4:
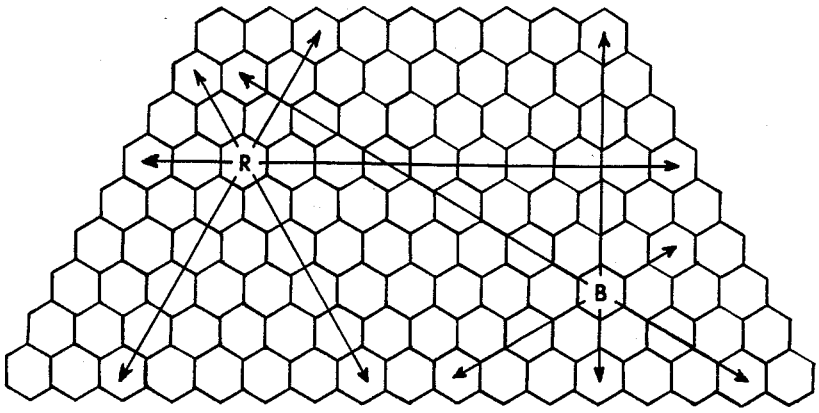
FIG. 4 is a segment of the game board illustrating the typical movement of a Rook piece and a Bishop piece.
Figure 5:
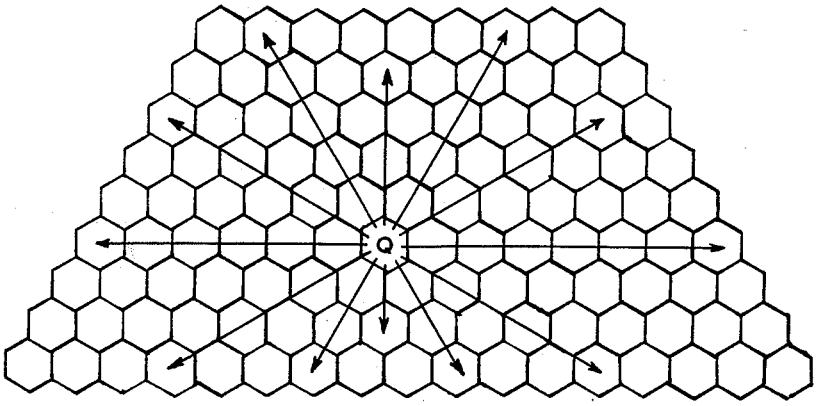
FIG. 5 is a segment of the game board illustrating the typical movement of a Queen piece.
Figure 6:
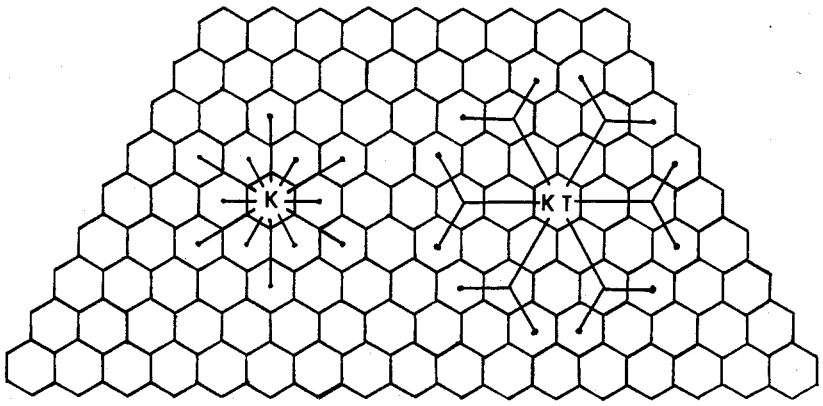
FIG. 6 is a segment of the game board illustrating the typical movement of a King piece and a Knight piece.
Figure 7:
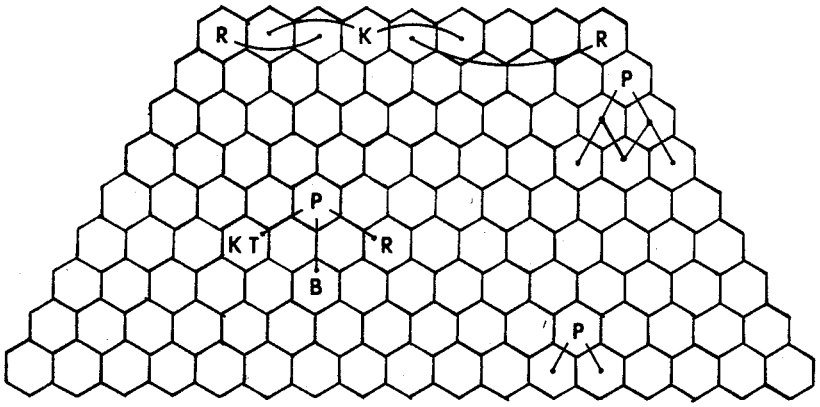
FIG. 7 is a segment of the game board illustrating the typical movement of the Pawn piece and castling.

Further, describing the movement of the pieces reference is made to the Drawings. FIG. 4 illustrates the movement of the Rook squarely through the sides of the hexagonal space. The Bishop moves diagonally through the points or corners of the hexagonal space. FIG. 5 illustrates the Queen movement in an unlimited distance in any of 12 directions squarely through the sides or diagonally through the corners of the hexagonal space. FIG. 6 illustrates the King movement squarely one space through the sides or diagonally through the corners of the hexagonal space. FIG. 6 also shows the special movement of the Knight two spaces squarely through the sides of the hexagonal space and one space squarely through the forward side of the second hexagonal space. FIG. 7 shows the typical movement of the Pawn; initially the Pawn may move squarely two hexagonal spaces forward through the adjacent sides of the hexagonal space. The Pawn subsequently moves squarely one space forward through the sides of the hexagonal space. To capture using a Pawn movement is made diagonally through the three forward points or corners of the hexagonal space into the space occupied by the captured playing piece. If a Pawn reaches the player's center row or beyond, the Pawn may be exchanged for a lost piece.

Figure 8:
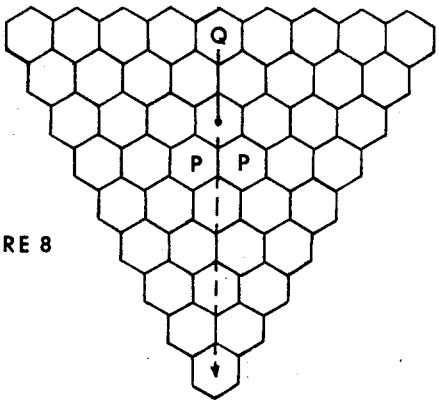
FIG. 8 is a segment of the game board illustrating the move known as a "block".

FIG. 8 illustrates a "block" which is created by two playing pieces which occupy adjacent hexagonal spaces through which a playing piece, which moves diagonally cannot move therebetween. Such as, the Queen which moves on the diagonal through the hexagonal corners cannot move between two adjacent pieces.

When a checkmate is achieved, the King is removed from the board. If more than two players are playing, the eliminated player's pieces remain on the board and can be captured but not moved, i.e., they have no power. The game proceeds between the remaining two players.

Figure 9:
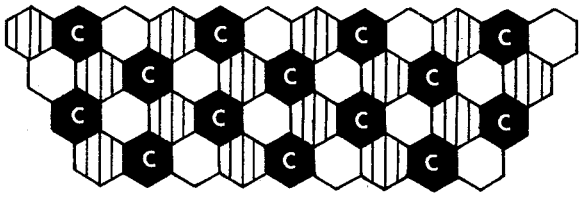
FIG. 9 is a view similar to FIG. 3 showing another possible initial set-up as for a game of checkers.
Figure 10:
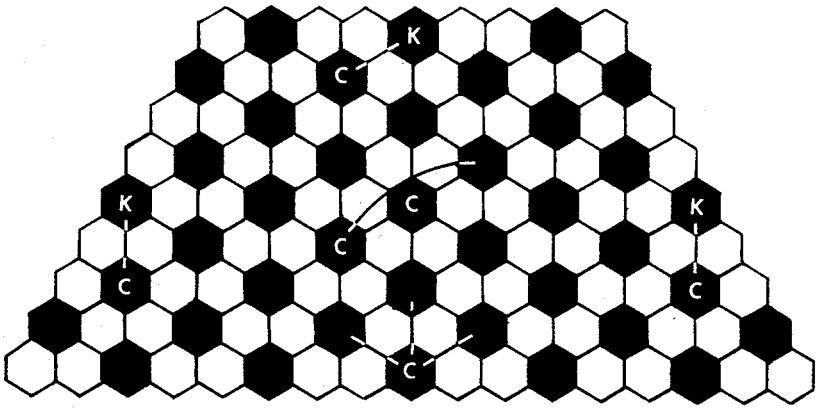
FIG. 10 is a segment of the game board illustrating movement of a checker piece and obtainment of a King.

As can be seen in FIGS. 9 and 10, the present concept and hexagonal game board can also be incorporated in the conventional game of checkers. The game can be played by two or three players, making the conventional checker moves and taking turns as described above. For purposes of identification, each set of chekers is colored differently in order that the sets may be readily identifiable to the respective players. FIG. 9 shows the initial set-up of the 14 checker playing pieces. FIG. 10 represents the moves, capturing moves and King formation.

Thus, it can be seen that the present invention has disclosed a two or three player chess game which is played ith substantially conventional rules but is more challenging. A new dimension to the game of chess is available on the hexagonal playing board with up to three players. Each player has to defend himself from the other two players and he must play offensively against each of them. No negotiations or team play is permitted. The game is played on an individual basis. Therefore, maximum interaction between the players is encouraged and naturally takes place.

Since the game is played according to conventional rules, no additional time is required to learn the rules of the particular game of chess or checkers using the hexagonal game board. Therefore, anyone who has familiarity with the conventional rules can play this game without any particular training or study.

It will be understood that this invention is susceptible to modification in order to adopt it to different usages and conditions, and accordingly, it is understood that such modifications within this invention as may fall within the scope of the appended claims is commensurate with the present disclosure.

I claim:

1. A hexagonal game board having six sides and containing 217 hexagonal spaces using three different colors, each row having alternately colored hexagonal spaces such that no two adjacent hexagonal spaces are of the same color each hexagonal space being connected to each adjacent hexagonal space by colored connecting spaces, said colored connecting spaces being of a color which is different from the color of the two adjacent hexagonal spaces.

2. A modified chess game played on a hexagonal board having 217 hexagonal spaces, each row having alternate colored spaces with no two adjacent spaces the same color, said chess game can be played by two or three players, comprising a hexagonal chess board, 19 conventional chess pieces per player, consisting of 10 Pawns, 2 Rooks, 2 Knights, 3 Bishops, 1 Queen and 1 King, each chess set having a different visual indicia thereon, the pieces of each chess set being movable over the entire board.

3. The modified chess game of claim 2 in which said visual indicia are contrasting colors.

4. The modified chess game of claim 2 in which the pieces move diagonally or squarely in the same manner as in regular chess.

5. A modified game of chess for up to three players utilizing 19 playing pieces per player consisting essentially of 10 Pawns, 2 Rooks, 2 Knights, 3 Bishops, 1 Queen and 1 King; each player represented by a different contrasting color as means to utilizing his pieces, movement of the pieces upon a hexagonal game board having 217 hexagonal spaces, in alternate turns between the players moving only one piece per turn per player, beginning from positions on the 19 interior hexagonal spaces bordering alternate sides of said hexagonal game board, and wherein said pieces are moved as in conventional chess, the object of which is to check mate an opponent's King.

* * * * *